United States Patent [19]

Lane

[11] 3,952,463

[45] Apr. 27, 1976

[54] FLEXIBLE COVER SUPPORT STRUCTURE

[75] Inventor: Duane W. Lane, Charlotte, Mich.

[73] Assignee: General Aluminum Products, Inc., Charlotte, Mich.

[22] Filed: May 29, 1974

[21] Appl. No.: 474,314

[52] U.S. Cl. ..... 52/63; 52/82; 52/632; 135/1 R

[51] Int. Cl.[2] ..... E04B 1/12

[58] Field of Search ..... 52/82, 632, 71, 63; 135/15 PQ, 1 R, 46 T; 248/353, 354 R; 403/107

[56] References Cited

UNITED STATES PATENTS

| | | | |
|---|---|---|---|
| 706,352 | 8/1902 | Smith | 135/46 T |
| 785,658 | 3/1905 | Branne | 135/46 T |
| 891,629 | 6/1908 | Munford | 135/46 T |
| 2,705,966 | 4/1955 | Magary | 135/15 PQ |
| 3,327,723 | 6/1967 | Burgin | 135/1 R |
| 3,333,373 | 8/1967 | Taylor | 52/82 |
| 3,335,535 | 8/1967 | Lane | 52/82 |
| 3,394,720 | 7/1968 | Moss | 52/63 |
| 3,454,021 | 7/1969 | Morris | 135/15 PQ |
| 3,461,890 | 8/1969 | Goodrich | 135/1 R |

*Primary Examiner*—Ernest R. Purser
*Assistant Examiner*—Henry Raduazo
*Attorney, Agent, or Firm*—Price, Heneveld, Huizenga & Cooper

[57] ABSTRACT

A support structure for a flexible cover such as is utilized on a portable enclosure wherein the tip of the supporting ribs or tubes engages the cover to maintain the same in position. The tip which is disclosed in this specification includes a shank section which is telescopically received by the tubular rib and a retaining section passable through a grommet in the cover. The tube is provided with a plurality of apertures and a resilient detent, forming a part of the tip, passes selectively thereinto to restrain telescopic movement of the tip with respect to the tube. The effective length of the rib can be altered by selectively positioning the detent in one of the apertures.

4 Claims, 6 Drawing Figures

FLEXIBLE COVER SUPPORT STRUCTURE

I. BACKGROUND OF THE INVENTION

This invention relates to a flexible cover support structure and, more particularly, to such a structure particularly adapted to accommodate size variations in the covers utilized therewith.

There is illustrated in U.S. Pat. No. 3,333,373 issued to Taylor on Aug. 1, 1967, and entitled Portable Folding Camping Cabin or House a portable enclosure which includes a series of flexibly interconnected rigid panels and a dome-shaped roof. The roof support comprises a plurality of upwardly-bowed, tube-like members extending radially from a central hub. These members include tips at their extremities specifically adapted to engage an encircling cable and to pass through grommets in the depending skirt of the fabric coverings to retain the same in overlying relationship with respect to the supports.

Assembly of the fabric cover to the structure is effected by passing the grommets over the tube tips at circumferentially spaced locations about the enclosure. This assembly procedure, when nearing completion, becomes increasingly difficult since it is necessary to stretch the fabric past the end of the tube so that the tube tips can pass through the grommet therein.

It is desirable, of course, that the cover be snugly retained on the supporting structure. It must be smooth and taut not only for aesthetic purposes but for functional reasons as well. These requirements, when combined with the requirement that the cover be stretchable radially a sufficient distance to permit passage of the tube tip through the grommet, have resulted in the past in a very narrow range of diameter tolerances for the cover. These tolerances have resulted not only in manufacturing difficulties but in consumer difficulties as well.

The fabric utilized for covers of this type, more particularly, has been found to be susceptible to shrinkage despite the utilization of preshrinking techniques prior to manufacture. This shrinking, which is aggravated by the wind, rain, sun, and other climatic conditions, typically takes place for a two- to three-year period after the cover has been in use. Where a particular cover was on the minimum side of the tolerance range at the completion of manufacture, this field shrinkage has interfered markedly with the ease with which structures of the type under consideration can be erected. It has resulted in some situations, in fact, in torn covers and covers which simply cannot be stretched a sufficient distance to permit the grommets to be passed over the ends of the tube tips.

II. OBJECTS AND SUMMARY OF THE INVENTION

It is an object of the present invention, therefore, to provide a support structure for flexible covers of the type under consideration which is not subject to the aforenoted difficulties.

It is an object of this invention, more particularly, to provide such a structure wherein size differences in the flexible cover, whether caused by shrinkage or manufacturing techniques, can be compensated for without impairing the utility of the structure in any manner.

It is a subsidiary object of this invention to provide a support structure for a flexible cover which greatly facilitates the ease with which the components can be assembled, despite the fact that the cover may have shrunk or have been on the minimum edge of the manufacturing tolerances from the beginning.

Briefly, these and other objects of this invention are accomplished in a shelter having a flexible covering member with a plurality of rib-like members underlying the same, the members having means attached to the extremities thereof for engaging the covering member and retaining it in overlying relationship with respect thereto. The present invention, specifically, comprises a means for adjusting the effective length of the rib-like members and attached engaging means whereby variations in the size of the covering member can be accommodated. This adjusting means includes a means for varying the effective point of attachment of the engaging means to the rib-like members.

III. DESCRIPTION OF THE DRAWINGS

IV. DETAILED DESCRIPTION OF THE INVENTION

Figure 1:
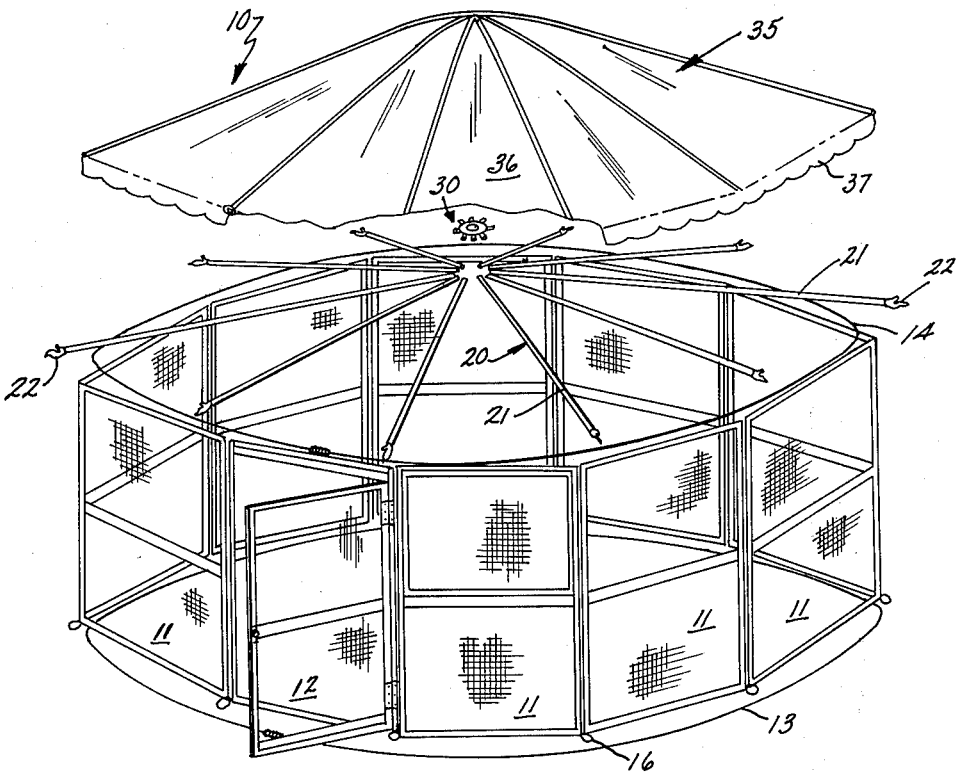
FIG. 1 is a perspective, exploded view of one type of enclosure to which the teachings of the present invention are applicable.
Figure 3:
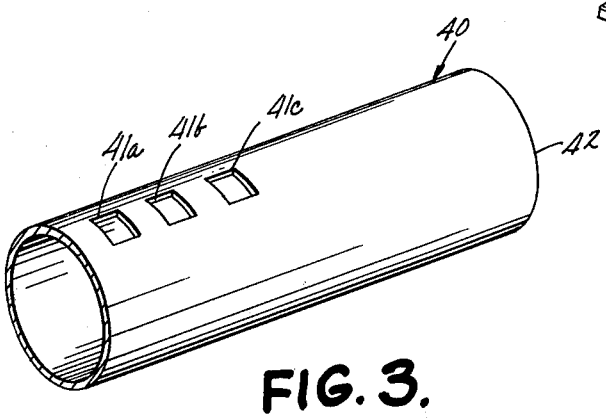
FIG. 3 is a fragmentary, perspective view of the extremity of the roof tube which is the subject of this invention.

Referring initially to FIG. 1, there is illustrated a portable structure 10 comprising a series of rigid panels 11 and a door panel 12. These panels are interconnected, one to the other, by means of a flexible hinge such that they can be stored in an accordion-fold configuration. The enclosure is assembled by unfolding the panels into a polygonal configuration of the type shown and inserting a hinge member onto the then-adjacent extremities.

Figure 2:
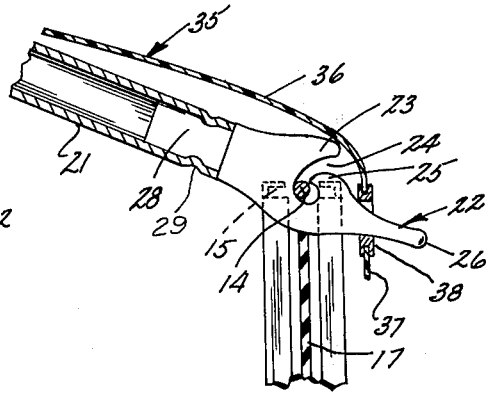
PRIOR ART. FIG. 2.
FIG. 2 is a cross-sectional view of a prior-art roof tube illustrating its mode of attachment to the side walls of the enclosure and to the flexible cover.
Figure 5:
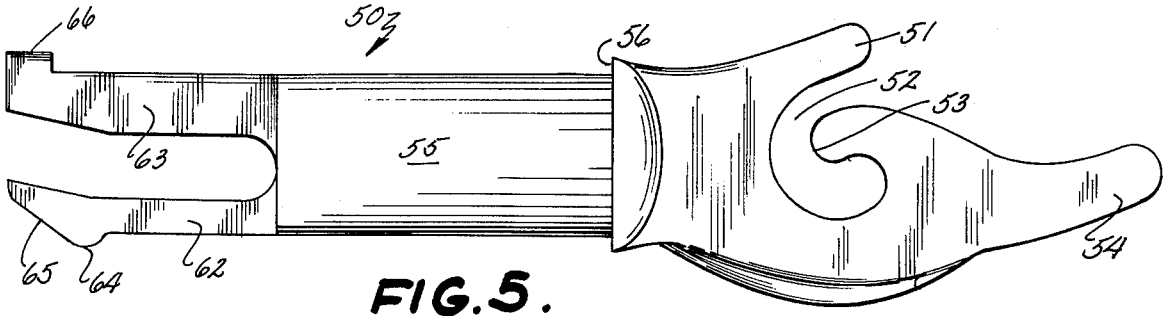
FIG. 5 is a side-elevational view of the tip shown in FIG. 4.

A detailed description of the mode of fabrication and assembly of the enclosure shown in FIGS. 1 and 2 appears in the aforenoted U.S. Pat. No. 3,333,373, the disclosure of which is specifically incorporated by reference herein. Reference can be made to this document by those who are unfamiliar with structures of the type under consideration for the thorough understanding of the same.

The enclosure illustrated has a lower cable 13 and an upper cable 14. These cables are positioned in channels along the bottoms and tops of the extrusions and preferably retained in place in the manner described and claimed in U.S. Pat. No. 3,335,535 issued Aug. 15, 1967, to Lane and entitled Cable Retaining Assembly. This patent is also incorporated specifically by reference herein. The upper channel of one of the members 11 or 12 is illustrated at 15 and the hinge which interconnects adjacent members at 17 in FIG. 2.

The enclosure, preferably, is staked or otherwise fastened to the ground utilizing the stake loops 16 which interconnect and surround the lower cable 13. The specific configurations of these assemblies are also illustrated in the aforenoted United States Patents.

A prior-art roof tube, illustrated generally in FIG. 1 and specifically in FIG. 2, includes an aluminum tube 21 and a tip 22. Tip 22 includes an outwardly extending hook formation 23 defining a downwardly opening passageway 24. This passageway receives the upper cables 14 during assembly of the apparatus, the same being partially retained by an overlying retainer 25. Protruding from the extremity of tip 22 is the elongated roof-retaining member 26. Tip 22, typically, has been molded from Delrin or Zytel including cylindrical shank 28 and affixed to the roof tube by means of staking as at 29.

Assembly of the roof structure illustrated in FIGS. 1 and 2 is accomplished through use of a hub member 30 having an annular center portion with a plurality of radially extending splines. Each of the splines telescopes into the open extremity of a roof tube. The tube is then forced radially inwardly so that the cable 14 passes into passageway 24. One tube, typically, extends from the central hub to each of the panel intersections. The tubes 20, which are straight prior to assembly, are of sufficient length and resilience to result in an upwardly bowed or inverted dish-shaped supporting structure for the roof 35.

Once assembly of the roof tubes has been completed, the roof or flexible cover 35 is placed thereover. Roof 35 includes a central section 36 having a depending skirt 37 about the exterior thereof. A series of grommets, circumferentially spaced so as to match the circumferential locations of the tube tips 22 are provided near the junction between central section 36 and the depending skirt 37.

The roof is affixed in overlying relationship with respect to the supporting tubes or ribs 20, as shown in FIG. 2, by passing the elongated roof-retaining member 26 at each of the tube tips 22 through a grommet 38. Such passage, as noted previously, can be accomplished with relative ease initially but becomes increasingly difficult toward the end of the procedure. This increasing difficulty is a product of the necessity of stretching the roof fabric radially outwardly a sufficient distance to pass the retaining member 26 into the grommets 37. If the roof has shrunk appreciably, the procedure sometimes becomes virtually impossible, resulting in either a torn roof or an uncompleted assembly and, invariably, a dissatisfied customer.

The present invention, illustrated specifically in FIGS. 3–6, remedies the foregoing situation by providing a roof tube-tip combination which is adjustable in length. When a situation such as that described previously is encountered, thus, one or more of the roof tubes may be shortened slightly so that the flexible roof can be properly assembled to the supporting structure.

The preferred embodiment of the invention includes a series of square aperture 41*a*, 41*b*, and 41*c* punched into the tube 40 near the tube tip-receiving extremity 42 thereof. These apertures receive the detent to be discussed hereinafter.

The novel tube tip 50 designed to cooperate with the novel tube 40 is identical at its exposed extremity to that utilized in the prior art. It includes a cylindrical shoulder 56, and an outwardly extending hook formation 51 forming downwardly opening passageway 52 with an overlying retainer 53. It also includes the elongated roof-retaining member 54 adapted to pass through the grommets on the flexible cover or roof.

Tube tip 50 has integrally formed therewith a cylindrical shank 55 which is somewhat longer, preferably, than that utilized in the prior art devices. The length of shank 55 should be such that a substantial portion thereof is encompassed by the tube when the detent is in its outermost position. The relative dimentions illustrated in FIG. 6 have been found satisfactory for this purpose.

Cylindrical shank 55 is telescopically receivable into the extremity 42 of tube 40. Its exterior diameter, relative to the interior diameter of the tube, should be such that it is freely slidable and, yet, restrained from appreciable canting movement when the assembly is adjusted to its maximum length with detent 66 in aperture 41*c*. Such restraint is enchanced, as will be pointed out in more detail hereinafter, by the U-shaped locking mechanism 60.

The U-shaped locking mechanism 60, preferably, is integrally molded as part of the tube tip 50, the entire structure being molded from Delrin, Zytel or similar material: It includes a curved bite 61 having a lower leg 62 and an upper leg 63. Lower leg 62 is provided near its extremity with a downwardly depending knob 64. Knob 64 functions to increase the resilient pressure tending to force detent 66 into apertures 41. A camlike approach ramp 65 extends from knob 64 to assist insertion of the mechanism in relaxed condition into the extremity 42 of the tube tip.

Upper leg 63 is provided with a square detent sized to fit apertures 41*a* through 41*c*. The locking member 60, in its relaxed condition, has a nominal diameter exceeding the inner diameter of the tube. The molding of the member from material such as those noted under relatively low moisture conditions, coupled with the approximate relative sizing illustrated, permits the legs 62 and 63 to compress resilently toward one another under the influence of camming surface 65. When the detent 66 is brought into registry with one of the apertures 41, it will pop into the position shown in FIG. 6 and, in such a position, restrain further telescopic movement of the tip 50 within the tube 40.

Figure 6:
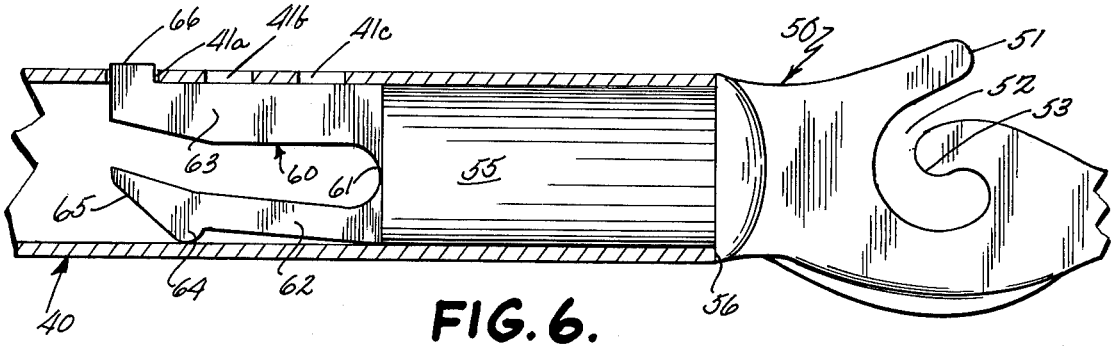
FIG. 6 is a fragmentary, side-elevational view, partially in cross section, of the tip and tube after the same have been assembled.
Figure 4:
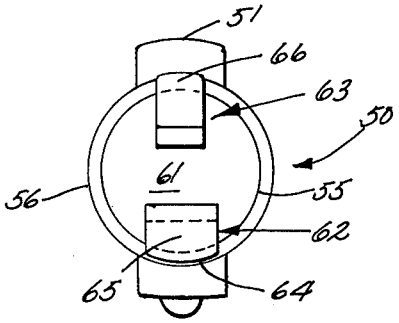
FIG. 4 is a rear-elevational view of the tube tip which is the subject of this invention.

The assembly illustrated in FIG. 6 is in its shortest position. The detent 66 can be positioned, additionally, in apertures 41*b* and 41*c* effectively lengthening the roof tube assembly. A new enclosure will be shipped, typically, with the detent 66 in aperture 41*c*. It is possible thereafter, if shrinkage of the cover occurs, for the purchaser to selectively shorten the effective length of the tube so that the undersized flexible cover or roof can be assembled.

It is important, in the preferred embodiment of the invention, that the detent 66 be positioned such that the loading forces, if any, tend to push detent 66 further into apertures 41. These forces, in the preferred embodiment, are the result of the bowed nature of the tubes when assembled and are applied at the tube tip by the upper cable 14. Detent 66, thus, faces upwardly or toward the fabric covering.

Adjustment of the effective length of a roof tube assembly can be effected by depressing detent 66 with a screw driver or similar tool and thereafter rotating an/or sliding the tip 50 in telescopic fashion to bring detent 66 into alignment with the desired aperture 41. It has been found, additionally, that where the apertures are punched into tube 40, the normal breakout will ordinarily permit the detent 66 to be disengaged from the aperture 41 by merely rotating the tip assembly 50 with respect to the tube 40. This procedure is facilitated by providing a slight radium along the sides of the upper faces of the detent as illustrated specifically in FIG. 4. Utilization of this mode of disengagement substantially facilitates adjustment of the tube length since it is necessary only to grasp tube 40 in one hand, tube 50 in the other, rotate tip 50 with respect to tube 40, slide the tip to the desired position and then rotate it in the opposite direction until the detent 66 passes into the desired aperture 41.

The instant invention provides, thus, a means whereby the supporting structure for a flexible member can be adjusted to accommodate size variations caused by shrinkage, manufacturing tolerances or the like. Such adjustment is easily effected in the field by the user, requires no elaborate tools and permits the utilization of an otherwise unworkable cover just as though it were correctly sized.

While a preferred embodiment of this invention has been disclosed and described in detail, it will be apparent to those skilled in the art that other embodiments may be conceived and fabricated without departing from the spirit and scope of this invention. Such other embodiments are to be deemed as included within the scope of the following claims unless these claims, by their language, expressly state otherwise.

The embodiments of the invention in which an exclusive property or privilege is claimed are defined as follows.

1. In a collapsible enclosure having a series of wall panels hingedly connected at their upright edges and arranged in a closed polygon; a dome-shaped framework above said panels including a series of outwardly and downwardly curved interconnected tubes, the tubes including means at their outer ends for engaging said panels to retain the framework in compression; and, a flexible roof overlying said framework, said roof being interlocked at circumferentially spaced points with said engaging means; the improvement comprising: said tubes having at least two apertures adjacent the outer extremity thereof, means for adjusting the effective length of said tubes and engaging means whereby variations in the size of said roof can be accommodated, said engaging means being integrally molded from plastic and including a shank portion telescopically slidable within the extremities of said tubes, said adjusting means including means for restraining sliding of said shank portion within said tube when said shank portion is in at least two differing positions within said tube, and said restraining means comprising a pair of spaced resilient legs attached to said shank portion and extendible into said tube therewith, detent means extending from one of said legs so as to be resiliently urged into one of said apertures when aligned therewith, for restraining sliding of said shank portion within said tube, the other of said legs including means for engaging the wall of said tube to compress said legs toward one another, the distance between said engaging means and said detent exceeding the diameter of said shank and the inner diameter of said tube prior to insertion of said restraining means into said tube.

2. The improvement as set forth in claim 1 wherein said enclosure further comprises a channel along the top edge of each of said panels and a panel securing cable threaded through and interlocked with said channels, said engaging means engaging said cable between adjacent panels.

3. The improvement as set forth in claim 2 wherein said roof includes a series of circumferentially spaced grommets about the circumference thereof and wherein said engaging means includes an elongated roof retaining member extending outwardly therefrom, said grommets adapted to be passed thereover.

4. The improvement as set forth in claim 1 wherein said other leg includes a slanted camming surface to facilitate insertion of said restraining means and shank portion into said tube.

* * * * *